United States Patent [19]

Danielsson

[11] Patent Number: 4,966,027

[45] Date of Patent: Oct. 30, 1990

[54] WIRE-ROD BLOCK

[75] Inventor: Kurt Danielsson, Smedjebacken, Sweden

[73] Assignee: Morgardshammar AB, Smedjebacken, Sweden

[21] Appl. No.: 315,573

[22] Filed: Feb. 27, 1989

[30] Foreign Application Priority Data

Mar. 11, 1988 [SE] Sweden ..... 8800880

[51] Int. Cl.[5] ..... B21B 35/00

[52] U.S. Cl. ..... 72/249; 72/235

[58] Field of Search ..... 72/249, 449, 235, 225

[56] References Cited

U.S. PATENT DOCUMENTS

| | | | |
|---|---|---|---|
| 749,823 | 1/1904 | Keller | 72/249 |
| 1,071,720 | 9/1913 | Fawell | 72/249 |
| 2,311,075 | 2/1943 | O'Malley | 72/249 |
| 4,019,360 | 4/1977 | Biernot et al. | 72/249 |
| 4,024,746 | 5/1977 | Bruck | 72/249 |

FOREIGN PATENT DOCUMENTS

| | | |
|---|---|---|
| 1427974 | 11/1968 | Fed. Rep. of Germany . |
| 1452155 | 11/1968 | Fed. Rep. of Germany . |
| 1445584 | 6/1966 | France . |
| 2386365 | 11/1978 | France . |
| 536143 | 6/1973 | Switzerland . |
| 2089259 | 6/1982 | United Kingdom . |

*Primary Examiner*—Lowell A. Larson
*Assistant Examiner*—Schoeffler, T. C.
*Attorney, Agent, or Firm*—Young & Thompson

[57] ABSTRACT

The present invention related to a wire-rod block which forms part of a wire rolling line and which includes two roll rings, between which the wire rod is rolled, and which further includes an input drive shaft and a gearing for transmitting the drive torque of the drive shaft to the roll rings. According to the invention, the input shaft (10) drives one of the roll ring shafts directly, via a first bevel gear (13) and also an output drive shaft (12), via a gear (11). The output drive shaft, in turn, drives the shaft of the other roll ring, via a second bevel gear (14), wherein the transmission ratios of the gear (11) and the bevel gears is such that the roll rings will rotate at mutually the same peripheral speeds.

3 Claims, 1 Drawing Sheet

WIRE-ROD BLOCK

The present invention relates to a wire-rod block which forms part of a rolling mill line and which includes two roll rings between which wire rod is rolled, an input drive shaft and gearing effective in transmitting drive torque from the drive shaft to the shafts carrying the roll rings.

Figure 1:
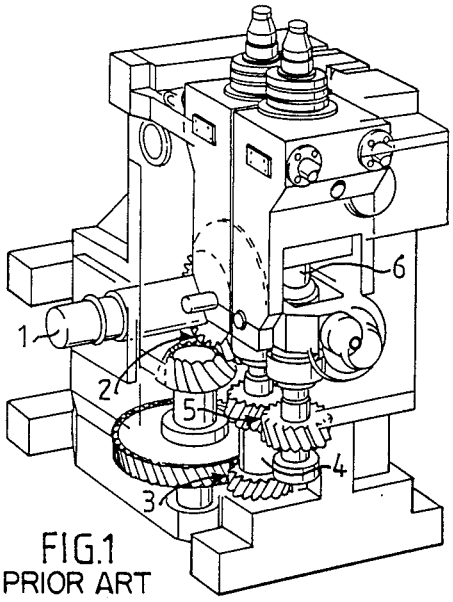
FIG.1 PRIOR ART

A known wire-rod block of this kind is shown in FIG. 1. In the case of this known block, the drive torque generated by the input shaft 1 is transmitted over a helical bevel gear 2 and a gear wheel 3 which has helical teeth and is mounted on a roll-ring carrying shaft 4, which, in turn, drives a roll-ring carrying shaft 6 synchronously with the shaft 4, over a gear wheel 5.

The object of the invention is to improve a wire-rod block of this kind, by reducing the number of rotating parts and by distributing the drive torque of the input shaft more efficiently.

This object is achieved with a wire-rod block of the aforesaid kind in that, in accordance with the invention, the input shaft drives one of the roll-ring carrying shafts directly over a first bevel gear and drives an output shaft over a further gear, the output shaft in turn driving the other roll-ring carrying shaft over a second bevel gear, wherein the transmission ratios between the gear wheel and the bevel gears are such that the roll rings will rotate at mutually the same peripheral speeds. The inventive wire-rod block thus has a separate bevel gear for transmitting the drive torque to each roll ring. Since the properties of the bevel gear of the known construction are dimensioned for the maximum drive torque that can be transmitted to the roll rings, the inventive construction enables a larger torque to be transmitted than said known construction, owing to the fact that the drive torque is distributed between two bevel gears. Furthermore, the inventive construction provides a more compact unit with fewer shaft bearings, because the reduction gear located behind the bevel gear of the known construction is not found in the inventive block. The inventive block is also advantageous from the aspect of maintenance, since the block can be easily disengaged form the wire rolling line and removed therefrom entirely, thereby enabling maintenance to be carried out at some other location.

Figure 2:
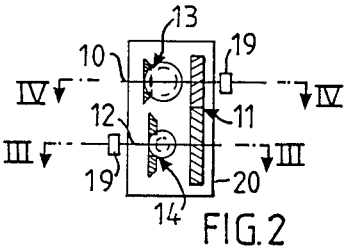
Figure 3:
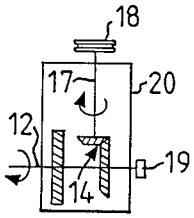
Figure 4:
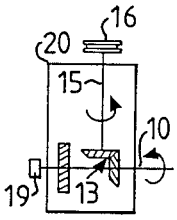

So that the invention will be more readily understood and further features thereof made apparent, a preferred embodiment of the invention will now be described in more detail with reference to the accompanying drawings, in which, FIG. 1 is a perspective view of a known wire-rod block, partly in section, FIG. 2 illustrates schematically an inventive block from above and in horizontal section, taken above the bevel gears, and FIGS. 3 and 4 are vertical sectional views of the block shown in FIG. 2 taken on the lines III—III and IV—IV, respectively, in FIG. 2. .

The wire-rod block according to the invention includes an input drive shaft 10 which drives an output shaft 12 via a reduction gear 11, said output shaft being intended to form the drive shaft for the nearest wire-rod block in the wire rolling line. The shaft 10 also drives a shaft 15 via a bevel gear 13. The shaft 15 is perpendicular to the shaft 10 and carries a roll ring on the end thereof remote from its bevel gear. The other roll ring, 18, of the block is carried by a shaft 17, which is driven by the output shaft, via a bevel gear 14. The described components, with the exception of the roll rings 16,18, are enclosed and journalled in a housing 20.

The roll rings 16,18 of the illustrated embodiment have mutually the same diameter, which means that the shafts 15,17 carrying the roll rings shall be driven for rotation at mutually the same speed, so as to achieve uniform rolling of the wire rod between the roll rings. The input shaft 10 is preferably driven at the same speed as that desired of the shaft 15, which thus implies that the bevel gear 13 shall have a transmission ratio of 1:1. Furthermore, this means that changing-up of the bevel gear 14 shall be commensurate with the change-down in the reduction gear 11, and consequently the transmission ratio in the gear 14 is inversely proportional to the transmission ratio in the gear 11.

The reference 19 identifies shaft couplings, which are shown schematically in FIGS. 2–4, wherewith the output shaft 12 of an upstream wire-rod block can drive the input shaft 10 of an adjacent downstream wire-rod block.

As will be seen from the aforegoing, the invention provides a wire-rod block of simple construction and with only few components. Compared with prior art wire-rod blocks, the invention provides a compact block with fewer components and therewith fewer bearings. This enables the roll rings to be rotated at higher speeds without risk of an increase in vibration stresses or bearing fractures. Maintenance is also simpler with the inventive block, since the whole unit can be dismantled and taken away from the rolling line, owing to the shaft couplings, whereafter a replacement can be readily fitted. This means that idling times will be shorter than was earlier the case and that maintenance need not be carried out on site.

I claim:

1. A wire-rod block forming part of a wire rolling line and including two roll rings between which the wire rod is rolled, an input drive shaft and a gearing which is effective in transmitting the drive torque of the drive shaft to the rings, characterized in that the input drive shaft (10) drives one (15) of the roll ring shafts directly, over a first bevel gear (13) and also an output shaft (12), over a gear (11), said output shaft in turn driving the shaft (17) of the other roll ring, over a second bevel gear (14), wherein the transmission ratio of the gearing and the bevel gears are such that the roll rings will rotate at mutually the same peripheral speed, and wherein each of said input drive shaft (10) and output shaft (12) comprises a shaft coupling (19), whereby said input drive shaft (10) is adapted to be driven by the output shaft of an adjacent upstream wire-rod block and said output shaft (12) is adapted to drive the input drive shaft of an adjacent downstream wire-rod block.

2. A block according to claim 1, characterized in that the gearing (11) is a reduction gear.

3. A block according to claim 2, characterized in that the bevel gear (13) between the input shaft (10) and one (15) of the two shafts carrying the roll rings (16,18) has a transmission ratio of 1:1, and in that the transmission ratio for the other bevel gear (14) is inversely proportional to the transmission ratio of the reduction gear (11).

* * * * *